US009125792B2

(12) United States Patent
Ji et al.

(10) Patent No.: US 9,125,792 B2
(45) Date of Patent: Sep. 8, 2015

(54) SPRAY PATTERN ADJUSTMENT NOZZLE FOR A BIDET

(75) Inventors: Yong Ji, Shanghai (CN); Hongchang Huang, Shanghai (CN)

(73) Assignee: SHANGHAI KOHLER ELECTRONICS, LTD. (CN)

( * ) Notice: Subject to any disclaimer, the term of this patent is extended or adjusted under 35 U.S.C. 154(b) by 387 days.

(21) Appl. No.: 13/536,752

(22) Filed: Jun. 28, 2012

(65) Prior Publication Data

US 2013/0042400 A1 Feb. 21, 2013

(30) Foreign Application Priority Data

Jun. 29, 2011 (CN) ..... 2011 1 0180174
Jun. 29, 2011 (CN) ..... 2011 1 20226751

(51) Int. Cl.

| | |
|---|---|
| ***A47K 3/20*** | (2006.01) |
| ***E03D 9/08*** | (2006.01) |
| ***A61H 35/00*** | (2006.01) |
| ***A61H 33/00*** | (2006.01) |
| *A61H 9/00* | (2006.01) |

(52) U.S. Cl.

CPC ..... *A61H 35/00* (2013.01); *A61H 33/6021* (2013.01); *E03D 9/08* (2013.01); *A61H 9/0021* (2013.01)

(58) Field of Classification Search

CPC ..... E03D 9/08
USPC ..... 4/420.4, 420.5, 447, 448
See application file for complete search history.

(56) References Cited

U.S. PATENT DOCUMENTS

| | | | | |
|---|---|---|---|---|
| 4,094,018 | A | 6/1978 | Bemthin | |
| 6,795,981 | B2 * | 9/2004 | Sato et al. | 4/420.4 |
| 8,321,969 | B2 * | 12/2012 | Jin | 4/420.4 |
| 2008/0016609 | A1 | 1/2008 | Jin | |

FOREIGN PATENT DOCUMENTS

| | | |
|---|---|---|
| CN | 1777722 | 5/2006 |
| CN | 1997798 | 7/2007 |
| CN | 201598707 | 10/2010 |
| CN | 202227444 | 5/2012 |
| JP | 2010101153 | 5/2010 |

OTHER PUBLICATIONS

First Office Action dated Jan. 29, 2013 in related Chinese matter 201110180174.7 6 pages.

* cited by examiner

*Primary Examiner* — Tuan N Nguyen
(74) *Attorney, Agent, or Firm* — Foley & Lardner LLP

(57) ABSTRACT

A spray nozzle system for a bidet includes a nozzle casing and a rotating member within the nozzle casing. The rotation of the rotating member changes a water output pattern of the nozzle. A first inlet pipe to the nozzle casing is positioned to cause the rotating member to rotate upon receiving fluid flow. A second inlet pipe to the nozzle casing is positioned to suppress rotation of the rotating member upon receiving fluid flow. A controller is configured to vary the relative fluid flow provided to the first inlet pipe and the second inlet pipe, thereby controllably varying the water output pattern of the nozzle.

20 Claims, 8 Drawing Sheets

SPRAY PATTERN ADJUSTMENT NOZZLE FOR A BIDET

CROSS-REFERENCE TO RELATED APPLICATIONS

The present application claims the benefit of and priority to Chinese Patent Application 201110180174.7, filed Jun. 29, 2011, and Chinese Patent Application 201120226751.7, filed Jun. 29, 2011, the entire contents of which are hereby incorporated by reference in their entirety.

BACKGROUND

The present invention relates to water jet devices in sanitary and bath products and in particular, to a nozzle, a water jet device, a jet pattern control system and an intelligent toilet.

Water jet devices in sanitary and bath products (e.g., bidets, toilet bidets, etc.) are configured for spraying water at human body parts. Some bidets include water jet devices that provide different spray patterns, pulse frequencies, massages, pressures, and the like. Some bidets, toilet bidets, or "smart toilets" allow a user to select the spray pattern.

Some conventional bidets provide diverse jet patterns using a nozzle having multiple controlled water spraying holes for changing the direction of cleaning water spray. Such conventional systems, however, do not provide for continuously variable jet patterns and do not provide for other than linear spray patterns.

SUMMARY

One embodiment of the invention relates to a nozzle for a bidet. The nozzle includes a nozzle casing and a rotating member within the nozzle casing. The rotation of the rotating member changes a water output pattern of the nozzle. A first inlet pipe to the nozzle casing is positioned to cause the rotating member to rotate upon receiving fluid flow. A a second inlet pipe to the nozzle casing is positioned to suppress rotation of the rotating member upon receiving fluid flow. A controller is configured to vary the relative fluid flow provided to the first inlet pipe and the second inlet pipe, thereby controllably varying the water output pattern of the nozzle.

The rotating member includes an impeller and an axle connected to one end of the impeller. The axle forms an angle with the axis of the impeller body. The impeller is disposed in a space formed between a lower casing of the nozzle and a connecting end of an upper casing of the nozzle. The free end of the axle is disposed at the outlet hole (the primary outlet of the nozzle) on the upper casing. Because of the angle between the axle (i.e., swing bar) and the impeller, the cleaning water at the free end of the axle is advantageously caused to be sprayed out in a rotating jet pattern. The rotating jet pattern is adjustable by controllably varying the water output pattern of the nozzle.

The cross section of an end surface of said nozzle may be rectangular. The shell of the lower casing may be box-shaped, and a hole may be formed on the top of the side of said shell for engaging with the first inlet pipe. The connecting end of said upper casing may be disposed inside said shell. The first inlet pipe may be disposed inside the hole formed on the side of said shell. The angle between the axis of the impeller body and the axle of the rotating member may be between 1 degree and 3 degrees.

One embodiment of the present invention relates to a nozzle, a water jet device, a jet pattern control system. The invention can be a part of an intelligent toilet or bidet. The nozzle may include an upper casing, a lower casing, and a rotating member disposed between the upper casing and the lower casing. The upper casing may include a first inlet pipe. The lower casing may include a second inlet pipe. An axle or swing bar of the rotating member may form an angle with the axis of the rotating member's impeller body. Due to the angle between the swing bar of the rotating member and the axis of the impeller body, the cleaning water at the free end of the swing bar is sprayed out a nozzle hole in a rotating jet pattern.

Another embodiment of the invention relates to a spray nozzle for a bidet. The spray nozzle includes a nozzle casing having an outlet hole through which water is sprayed. The spray nozzle also includes a rotating member within the nozzle casing. The rotating member is configured to rotate around an axis of rotation as water flows through the nozzle. The rotating member is an axle at an angle relative to the axis of rotation of the rotating member. The axle extends at least partially into the outlet hole causing water to spray in a rotating pattern with rotation of the rotating member.

DETAILED DESCRIPTION

To improve jet patterns of water jet devices such as those used in toilets, toilet bidets, or bidets, the embodiments of the present invention include a nozzle, a water jet device, and a jet pattern control system. The present invention will be described in detail below with reference to the accompanying drawings.

Figure 1:
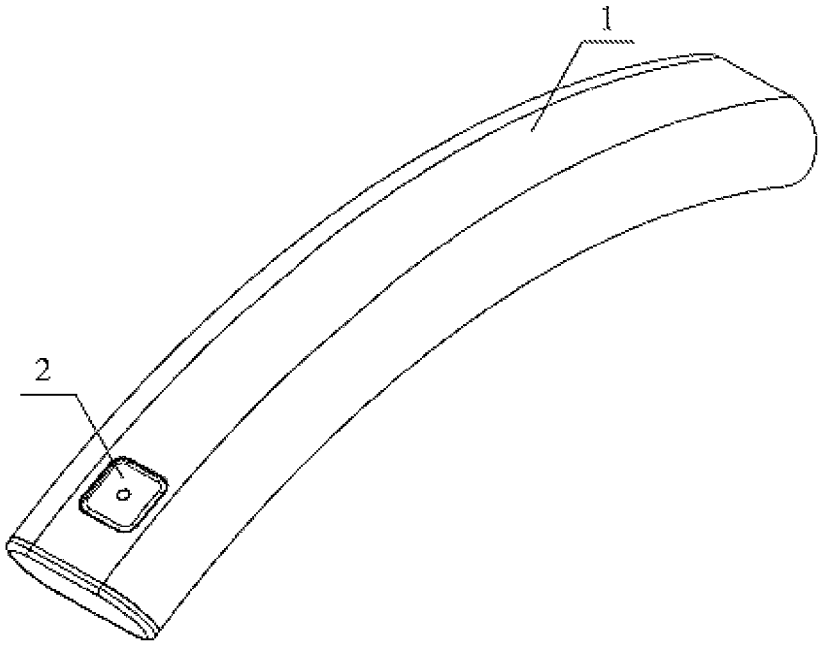
FIG. 1 is a perspective view of a water jet device having a nozzle 2 installed within a nozzle tube 1, according to an exemplary embodiment.

FIG. 1 illustrates a water jet device, according to an exemplary embodiment. The water jet device may be a part of a toilet, bidet, or toilet bidet and may be positioned to spray water at a user's body. The water jet device includes a nozzle tube 1 and a nozzle 2 disposed inside the nozzle tube. The nozzle 2 is disposed at one end of the nozzle tube 1. The nozzle 2 may be separable from the nozzle tube 1, allowing replacement of the nozzle 2 of the water jet device.

The nozzle tube 1 may be round or flat according to varying embodiments. Further, the nozzle tube 1 may be straight or curved. In the embodiment illustrated in FIG. 1, said nozzle tube 1 is curved. The nozzle tube 1 includes a hole at one end for the nozzle 2. The nozzle 2 is largely housed within the nozzle tube 1. The upper casing 21 of the nozzle 2 engages with the hole in nozzle tube 1 and a portion of the upper casing is visible through the hole in nozzle tool 1.

Figure 2:
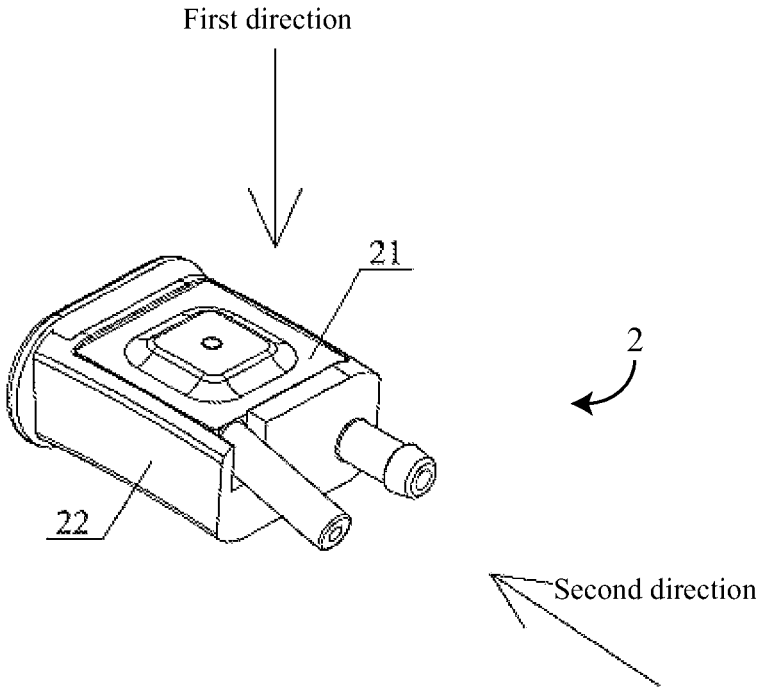
FIG. 2 is a perspective view of the nozzle 2 without the nozzle tube 1, according to an exemplary embodiment.

FIG. 2 illustrates the structure of the nozzle 2. The nozzle 2 includes an upper casing 21 and a lower casing 22.

Figure 3:
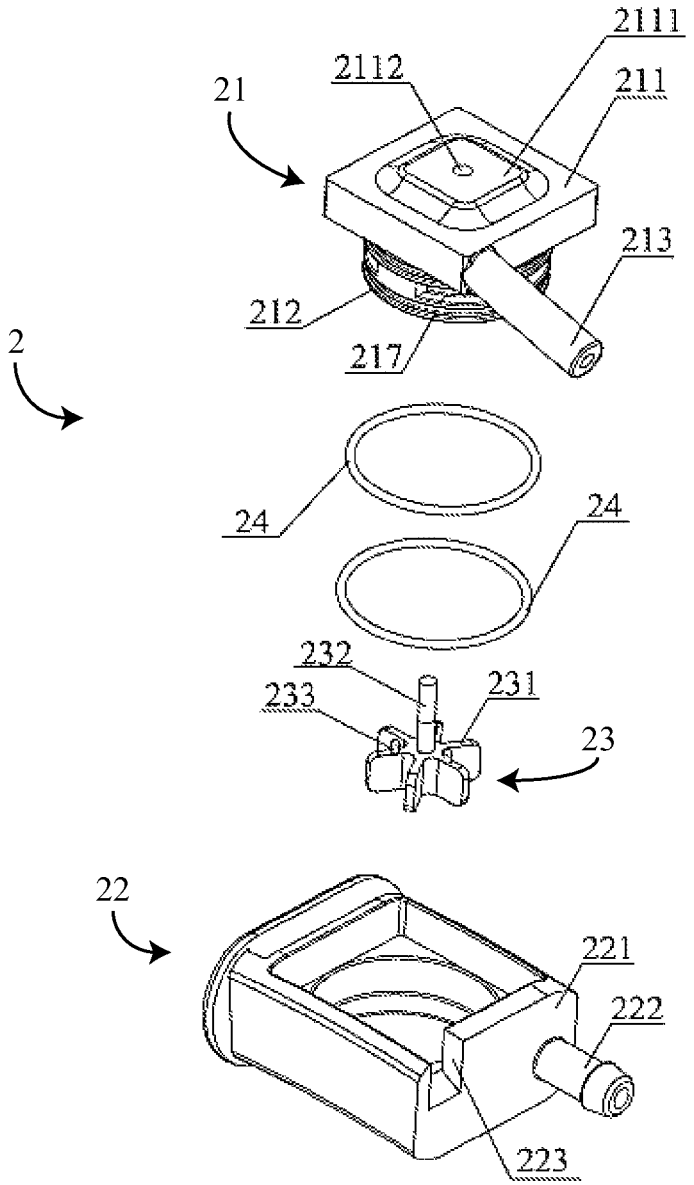
FIG. 3 is an exploded view of the nozzle in FIG. 2, according to an exemplary embodiment.
Figure 4:
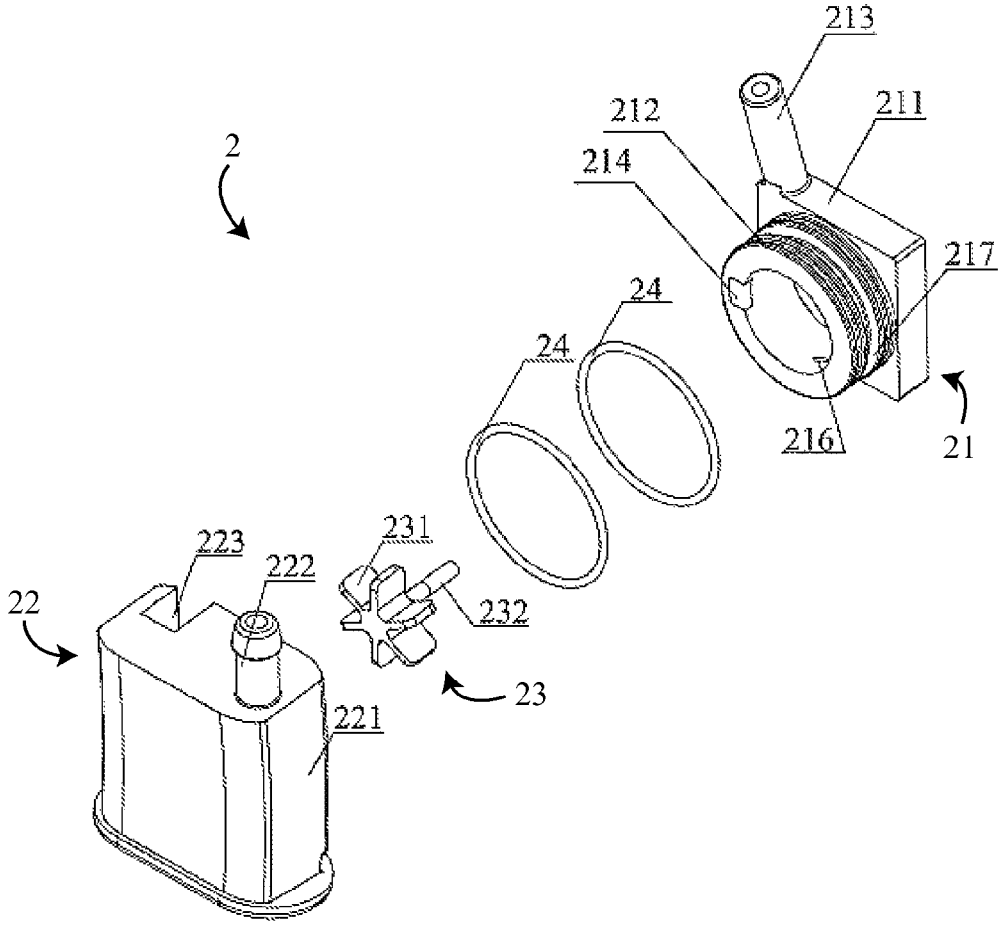
FIG. 4 is another exploded view of the nozzle in FIG. 3 as viewed from another direction, according to an exemplary embodiment.

FIG. 3 is an exploded view of the nozzle 2 of FIGS. 1 and 2, according to an exemplary embodiment. FIG. 4 is an exploded view of the nozzle 2 shown from another direction. Upper casing 21 includes an end surface 211, a connecting end 212, and a first inlet pipe 213. The cross section of the end surface 211, as illustrated in FIG. 3, is rectangular. An outlet hole 2112 is formed on the end surface 211.

In varying embodiments, the cross section of said end surface 211 may be other shapes such as round or oval.

The connecting end 212 is tubular, and one end of the connecting end 212 is connected (i.e., integrally connected) to the bottom surface of said end surface 211.

The first inlet pipe 213 is connected to one end of one side of said end surface 211. Cleaning water in the first inlet pipe 213 can enter the space formed within the connecting end 212 of the upper casing 21 and the lower casing 22. The first inlet pipe 213 may lead into the space formed within the end surface 211 and the connecting end 212. The lower casing 22 includes a shell 221, a second inlet pipe 222, and a hole 223 for engaging with the first inlet pipe 213 of the upper casing 21.

To connect the upper casing 21 and the lower casing 22, said shell 221 is a box formed by five faces. In varying embodiments, shell 221 may be of other shapes such as a hollow sphere, an irregular shape with an opening, or other shapes.

A second inlet pipe 222 is connected to the side of said shell 221. Cleaning water in the second inlet pipe 222 enters the shell 221 and the second inlet pipe 222 is connected into the internal space formed by said shell 221.

A hole 223 is formed on the top of the side of the shell 221 connected with the second inlet pipe 222 for engaging with the first inlet pipe 213. The connecting end 212 of the upper casing 21 is disposed inside said shell 221. The first inlet pipe 213 is disposed inside the hole 223 formed on the side of the shell 221, and the end surface 211 of said upper casing 21 functions as the cover of said box. In the present invention, the end surface 211 of said upper casing 21 can function as the cover of the shell 221 of the lower casing 22. In an exemplary embodiment, the sealing between the upper casing 21 and the lower casing 22 is achieved via a sealing ring or rings 24.

The rotating member 23 is shown to include an impeller 231 and an axle 232 connected to one end of the impeller 231. The impeller 231 includes a plurality of vanes. The axle 232 in said rotating member 23 may form an angle with the axis of the body of the impeller 231. The angle may be between 1 degree to 3 degrees. In some embodiments, the angle is between about 1.5 degrees to 2.5 degrees. The vanes of the impeller 231 may include projections 233. The rotating member 23 is disposed between the upper casing 21 and the lower casing 22. The impeller 231 of the rotating member 23 is disposed in the space formed by the lower casing 22 and the connecting end 212 of the upper casing 21. The free end of the axle 232 is disposed at the outlet hole 2112 of said upper casing 21.

To ensure the sealing of the connected upper casing 21 and lower casing 22 in the present invention, the nozzle 2 further includes a sealing ring 24. The sealing ring 24 may be connected to the external side of the connecting end 212 of the upper casing 21. More than one sealing ring 24 may be used in varying embodiments. The sealing ring or rings 24 may be made of an elastic material, such as rubber. A sealing ring fixing groove may be formed on the external side of the connecting end 212 of the upper casing 21 to facilitate seating of the sealing ring. The sealing ring fixing groove on the connecting end may have relatively high roughness or depth to ensure engagement between the sealing ring 24 and the external side of the connecting end 212.

As shown in FIG. 4, a sealing ring fixing groove is formed on the external side of the connecting end 212. In an exemplary embodiment, the diameter of the sealing ring fixing groove on the end of the external side of the connecting end 212 that connects with the end surface 211 is greater than the diameter of the sealing ring fixing groove on the end far away from the end surface 211. In other words, to help ensure the sealed engagement of the inner side of the shell 221 of the lower casing 22 with the upper casing 21, sealing rings of two different diameters may be used.

As shown in FIG. 3, the top surface of the end surface 211 of the upper casing 21 further includes a boss 2111. The outlet hole 2112 is formed at the center of said boss 2111. When the nozzle 2 is connected with the nozzle tube 1, the boss 2111 projects out of the hole in the nozzle tube.

The water introduced into the first inlet pipe 213 enters the space formed by the end surface 211 and the connecting end 212. The upper casing 21 includes a connecting hole 215 (illustrated in FIG. 8) and an internal channel 214. The connecting hole 215 is disposed at the end of the first inlet pipe 213 that connects with said end surface 211, and the water path of the first inlet pipe 213 is open to said connecting hole 215.

The internal channel 214 is disposed inside the connecting end 212 with one end thereof connected to said connecting hole 215, for receiving water via connecting hole 215. The other end of internal channel 214 extends to the bottom of the connecting end 212 and opens into the space formed by said end surface 211 and said connecting end 212.

The second inlet pipe 222 is connected into the internal space formed by the shell 221. When the upper casing 21 and the lower casing 22 are connected, the cleaning water introduced into the second inlet pipe 222 (that is connected to the lower casing 22) drives the rotating member 23 upon entering the internal space formed by the shell 221 and the connecting end 212. An inlet hole 216 is formed on the side of said connecting end 212 and receives cleaning water from the second inlet pipe 222 for driving the rotating member 23.

To help the cleaning water in the second inlet pipe 222 drive the rotating member 23, a groove 217 is provided at a height on the external side of the connecting end 212 that corresponds with the location of the second inlet pipe 222, as shown in FIG. 3. In an exemplary embodiment, the groove 217 wraps around the external wall of the connecting end 212. Holes 216 are disposed on the bottom of said groove 217 and receive water from the groove 217. Water output from holes 216 drives the rotating member 23. A view of the orientation of holes 216 can be viewed in, e.g., FIG. 11.

Figure 5:
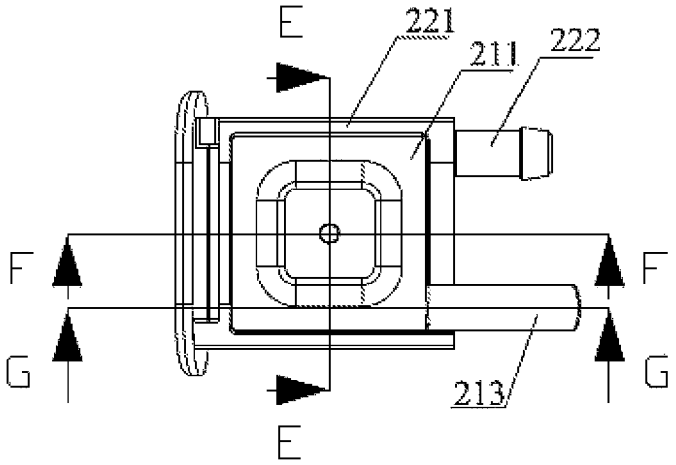
FIG. 5 is a view of the nozzle as viewed from the first direction specified in FIG. 2.

FIG. 5 is a view of the nozzle as viewed from the first direction identified in FIG. 2. In FIG. 5, the port of the shell 221 of the lower casing 22 closely engages with the end surface 211 of the upper casing 21. The first inlet pipe 213 and the second inlet pipe 222 are disposed at the same side of said nozzle. Other orientations may be provided, according to varying embodiments. In subsequent Figures, cross-sectional views of said nozzle are provided in the F-F, G-G and E-E directions relative to FIG. 5.

Figure 6:
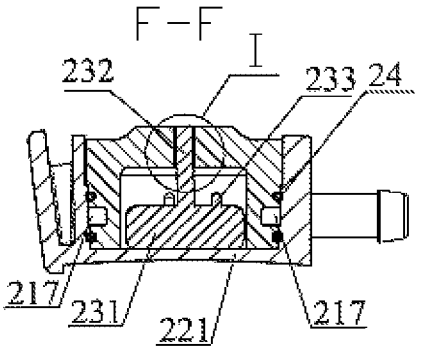
FIG. 6 is a cross-sectional view of the nozzle in the F-F direction specified in FIG. 5.

FIG. 6 is a cross-sectional view of the nozzle in the F-F direction in FIG. 5. It can be seen from FIG. 6 that the vane or vanes 231 of the rotating member 23 are disposed inside the space formed by the end surface and the connecting end of the upper casing and the shell 221 of the lower casing. The free end of the axle or screw 232 of the rotating member 23 is disposed at the outlet hole on the end surface of the upper casing of the nozzle. It can be seen from said cross-sectional view that said vane 231 may include a projection or projections 233.

A sealing ring or rings 24 are connected to the external side of the connecting end of the upper casing. Groove 217 is disposed on the external side of the connecting end 212 and extends in the circumferential direction. The height of said groove 217 on the external side of the connecting end 212 matches the height of the second inlet pipe 222 after the upper casing 21 and the lower casing 22 are connected.

The external side of said shell 221 (the left side as viewed on paper in FIG. 5) is shown as matching the shape of the end of the nozzle tube. Since said nozzle tube is a curved and flat tube, the external side may form an angle with the vertical axis of the shell for engagement with the end of the nozzle tube (e.g., the angle based on the curve of the nozzle tube 1). As shown in FIG. 6, said shell and the side parallel to the side connected with the second inlet pipe may be of two layers. The first layer forms a closed space of said shell together with other shell sides. The second layer forms an angle with the first layer. As previously mentioned, the magnitude of said angle may be set to match the curve of the nozzle tube.

Figure 7:
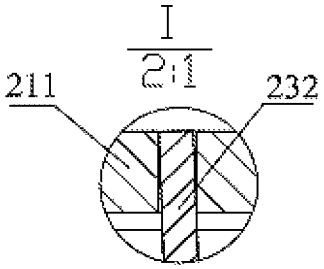
FIG. 7 is a close-up view of the Area I in FIG. 6.

FIG. 7 is close-up view of the area I of FIG. 6. The free end of the axle or screw 232 of the rotating member 23 is disposed at the outlet hole on the end surface. The axis of the impeller body forms an angle with the axle 232 of the rotating member. The diameter of the outlet hole in the end surface 211 is greater than the diameter of the screw 232. The twisting of the axle 232 in the outlet hole under water pressure and because of rotation by the impeller causes the formation of a jet pattern. In an exemplary embodiment, the diameter of the outlet hole is large enough to ensure that the axle 232, at the angle with the axis of the impeller body, can freely swing 360 degrees without being limited by the diameter of the outlet hole.

Figure 8:
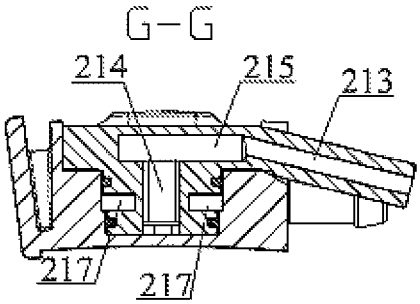
FIG. 8 is a cross-sectional view of the nozzle in the G-G direction specified in FIG. 5.

FIG. 8 is a cross-sectional view of the nozzle in the G-G direction of FIG. 5. The inlet path of said first inlet pipe 213 is connected to the connecting hole 215 disposed inside the end surface. Water introduced into said first inlet pipe 213 to enters the connecting hole 215 in the space formed by the end surface and the connecting end. An internal channel 214 is disposed inside said connecting end. One end of the internal channel 214 is connected to said connecting hole 215. The other end of the internal channel 214 extends to the bottom of the connecting end 212 generally projects water in the space within which the rotating member 23 resides. It can be seen from FIG. 8 that the groove 217 is not connected with the internal channel 214. In other words, groove 217 and channel 214 do not intersect.

Figure 9:
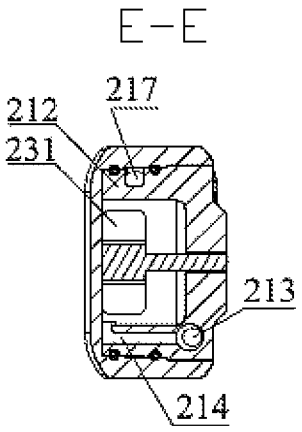
FIG. 9 is a cross-sectional view of the nozzle in the E-E direction specified in FIG. 5.

FIG. 9 is a cross-sectional view of the nozzle in the E-E direction in FIG. 5. As shown in FIG. 9, the first inlet pipe 213 is open to the space formed by the end surface and the connecting end via said internal channel 214. As further shown in FIG. 9, in the present invention, the height of said impeller 231 is smaller than the height of the connecting end 212, and the diameter of the impeller 231 is smaller than the inner diameter of said connecting end 212. Moreover, it can be seen from the cross-sectional view of the nozzle in the E-E direction that the groove 217 is disposed at the external side of the connecting end 212.

Figure 10:
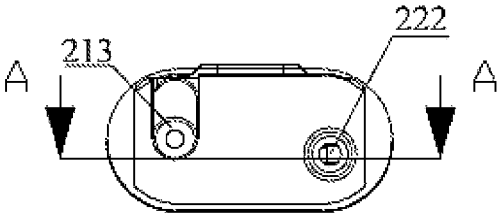
FIG. 10 is a view of the nozzle as viewed from the second direction specified in FIG. 2.

FIG. 10 is a view of the nozzle in the second direction of FIG. 2. As shown in FIG. 10, the first inlet pipe 213 is disposed on the upper casing and the second inlet pipe 222 is disposed on the lower casing. The first inlet pipe 213 and the second inlet pipe 222 are disposed on the same side of the nozzle 2, and the first inlet pipe 213 in the upper casing is disposed slightly above said second inlet pipe 222 in the view of FIG. 10.

Figure 11:
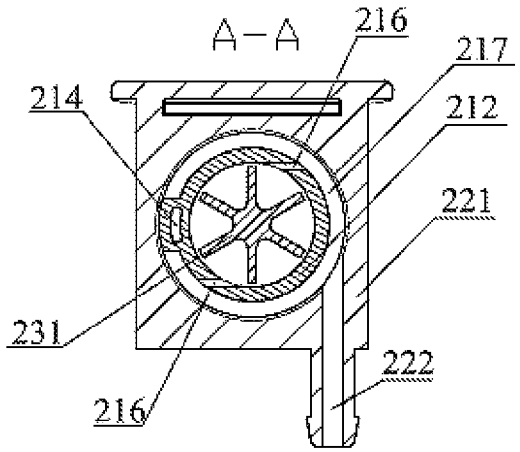
FIG. 11 is a cross-sectional view of the nozzle in the A-A direction specified in FIG. 10.

FIG. 11 is a cross-sectional view of the nozzle in the A-A direction of FIG. 10, i.e. a cross-sectional view at roughly the same height as the second inlet pipe. The groove 217 is shown as formed circumferentially along the connecting end 212. As the connecting end 212 of the upper casing is disposed inside the shell 221 of the lower casing, moreover, the connecting end 212 of the upper casing and the shell 221 of the lower casing jointly form a whirling water chamber. For the cleaning water introduced into the second inlet pipe 222 on the lower casing to enter the space formed by the connecting end 212 and the shell 221, an inlet hole or holes 216 is formed on the bottom of the groove 217. As shown in FIG. 11, moreover, an internal channel 214 is further formed inside said connecting end 212 that connects with the first inlet pipe 213 (not shown), and the cleaning water introduced into the first inlet pipe 213 enters the space formed by the connecting end 212 and the shell 221 via said internal channel 214.

It can be seen from the Figures that the cleaning water introduced into the first inlet pipe 213 enters the internal channel 214 via the connecting hole 215, and subsequently enters said water chamber (having the rotating member 23) via the hole at the bottom end of the internal channel 214.

When the water jet device is installed, the cleaning water is introduced into the first inlet pipe 213 and the cleaning water enters the connecting hole 215 via the first inlet pipe 213, The cleaning water in the connecting hole 215 flows into the internal channel 214 and enters the water chamber (having the rotating member 23) through the hole on the bottom of the internal channel. When the cleaning water is introduced into the second inlet pipe 222, the cleaning water flows into the circular flow path formed by the groove 217 because the second inlet pipe is aligned with the groove 217 on the external side of the connecting end 212, while an inlet hole or holes 216 are formed on the bottom end of said groove 217, causing a circular flow path and rotation of the rotating member.

In the present invention, the cleaning water introduced into the first inlet pipe 213 may be referred to as the first cleaning water, while the cleaning water introduced into the second inlet pipe 222 may be referred to as the second cleaning water. Since the second cleaning water enters from the inlet hole 216 on the bottom end of the groove 217, it can cause water to flow past the impeller from the side, driving the impeller to rotate. The first cleaning water pressurizes the water chamber having the rotating member such that the water flow resistance in the water chamber increases, thereby suppressing the rotation of the impeller.

Since projections are connected to the vanes of said impeller, the projections on the vanes also rotate continuously along with the rotation of the impeller, reducing friction in the water chamber and preventing the axle from extending too far out of the outlet hole of the nozzle. Due to the angle between the axle of the rotating member and the axis of the impeller body, and due to cleaning water in the water chamber attaching to the axle due to a wall-attachment effect, the water is ultimately swung out from the outlet hole via the free end of the axle, and the resulting spray has a rotating jet pattern. The intensity of the second cleaning water can be strengthened by changing the relative pressures of water introduced to the first inlet pipe 213 and the second inlet pipe 222. The intensity of the first cleaning water can be weakened, for example, when a high-speed rotation (caused by water pressure at the second inlet pipe) is needed for massaging and cleaning. The opposite effect can be achieved by reversing the first inlet pipe/second inlet pipe pressure relationship. For example, when a low-speed rotation is needed for massaging and cleaning, the intensity of the first cleaning water can be strengthened and the intensity of the second cleaning water can be weakened. When the intensity of the first cleaning water is strengthened and the intensity of the second cleaning water is weakened, the rotation speed of the impeller in the rotating member is decreased and the straight cleaning water sprayed from the free end of the swing bar (i.e., axle) per second is increased, thereby making the user feel that the cleaning water is relatively powerful.

Figure 12:
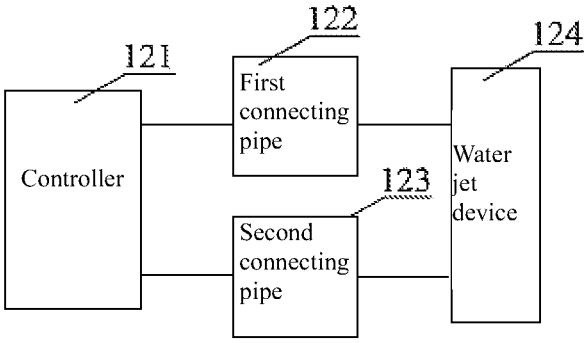
FIG. 12 is a block diagram of an overall jet pattern control system within which the water jet delivery device and more particularly nozzle 2 can be implemented, according to an exemplary embodiment.

In an exemplary embodiment, the present invention provides a jet pattern control system as illustrated by the block diagram of FIG. 12. The jet pattern control system of FIG. 12 includes a controller 121, a first connecting pipe 122 for connecting to the first inlet pipe 213 (shown in previous Figures), a second connecting pipe 123 for connecting the second inlet pipe 222 (shown in previous Figures) and a water jet device 124 (the device as variously illustrated in FIGS. 1-11).

The controller 121 may receive a jet pattern control signal (e.g., specifying a user-requested water jet pattern for outputting from the nozzle 2). Using the received jet pattern control signal, the controller can determine the ratio of cleaning water allocated into the first connecting pipe 122 and the second connecting pipe 123. The controller can use one or more valves to direct cleaning water into the first connecting pipe 122 and/or the second connecting pipe 123 according to the determined allocation ratio.

The first connecting pipe 122 and the second connecting pipe 123 provide the received cleaning water into the first inlet pipe 213 and the second inlet pipe 222, respectively. A rotation jet pattern is formed by the rotation of the impeller 231 in the water jet device 124 (i.e., nozzle 2) caused by the cleaning water received at the second inlet pipe 222 and the suppression of the rotation of said impeller by the cleaning water from the first inlet pipe 213.

The control signal received by the controller in the present invention may be either a control signal transmitted by a wireless remote control or a control signal transmitted by a wired control panel. When the controller 121 receives the control signal, it determines the allocation ratio of cleaning water into the first connecting pipe 122 and the second connecting pipe 123 based on the control signal. The controller 121 can then transmit the allocation ratio to a water distributor. The water distributor can send cleaning water into the first connecting pipe and the second connecting pipe according to the allocation ratio. The water enters the first inlet pipe 213 and the second inlet pipe 222 via the first connecting pipe 122 and the second connecting pipe 123, respectively.

As an example of a rotation jet pattern provided by the system, if the intensity of the second cleaning water supply from the second cleaning pipe 123 is caused to be relatively high and the intensity of the first cleaning water from the first cleaning pipe 122 is caused to be relatively low, then more cleaning water is introduced into the second connecting pipe 132 and the second inlet pipe 222, causing more rotation. When the low-speed rotation is needed, the intensity of the second cleaning water supply is caused to be relatively low and the intensity of the first cleaning water is caused to be relatively high, suppressing rotation of the impeller 23.

The controller 121 may be configured to provide stepped settings or may control the jet pattern via stepless speed regulation. The maximum ratio of the cleaning water entering the second connecting pipe to the cleaning water entering the first connecting pipe may be set for massaging and cleaning at high-speed rotation, and the minimum ratio of the cleaning water entering the second connecting pipe to the cleaning water entering the first connecting pipe may be set for massaging and cleaning at low-speed rotation. In an exemplary embodiment, a user may choose any ratio between the maximum ratio and said minimum ratio. When the controller receives the ratio, it may transmit the ratio to a water distributor (e.g., one or more variable position valves), and the water distributor then allocates cleaning water into the first connecting pipe and the second connecting pipe according to the ratio.

The present invention provides a nozzle, a water jet device, a jet pattern control system and an intelligent toilet. Said nozzle comprises: an upper casing, a lower casing, and a rotating member disposed between the upper casing and the lower casing, said upper casing comprises a first inlet pipe, said lower casing comprises a second inlet pipe, said first inlet pipe and second inlet pipe are connected into the space formed by the upper casing and the lower casing, and the swing bar of said rotating member forms an angle with the axis of the impeller body. Due to the angle between the swing bar of said rotating member and the axis of the impeller body in the present invention, said rotating member rotates under the pushing force of the cleaning water from the inlet pipes when the cleaning water is introduced into the first inlet pipe and the second inlet pipe. Because of the angle between the swing bar and the impeller, the cleaning water at the free end of the swing bar is swung out in a rotating jet pattern, thereby achieving an ideal rotating jet pattern.

What is claimed is:

1. A nozzle system for a bidet, comprising:

a nozzle casing;

a rotating member within the nozzle casing, wherein the rotation of the rotating member changes a water output pattern of the nozzle;

a first inlet pipe to the nozzle casing positioned to suppress rotation of the rotating member upon receiving fluid flow;

a second inlet pipe to the nozzle casing positioned to cause the rotating member to rotate upon receiving fluid flow; and a controller configured to vary the relative fluid flow provided to the first inlet pipe and the second inlet pipe to controllably vary the water output pattern of the nozzle.

2. The nozzle system of claim 1, wherein the casing further comprises:

an upper casing; and a lower casing;

wherein the rotating member is located between the upper casing and the lower casing.

3. The nozzle system of claim 2, wherein the upper casing comprises an end surface and a connecting end;

wherein, an outlet hole is formed on the end surface and the connecting end is tubular, with one end thereof projecting from the bottom surface of said end surface;

wherein the first inlet pipe is connected to one side of said end surface and provides fluid into a space formed by the end surface and the connecting end.

4. The nozzle system of claim 3, wherein the lower casing comprises a shell, and wherein the second inlet pipe is connected to a side of the shell and provides fluid into the internal space formed by said shell.

5. The nozzle system of claim 4, wherein said rotating member comprises:

an impeller and an axle connected to one end of the impeller, wherein the axle forms an angle with the axis of the impeller; said impeller is disposed in an open space formed by said lower casing and the connecting end of the upper casing, and the free end of said axle is disposed at the outlet hole of said upper casing.

6. The nozzle system of claim 5, wherein the upper casing further comprises a connecting hole and an internal channel;

wherein the connecting hole is disposed inside said end surface, and the first inlet pipe provides water to the connecting hole;

wherein the internal channel is disposed inside the connecting end with one end of the internal channel connected to said connecting hole and the other end of the internal channel extending to the bottom of the connecting end and reaching inside the space formed by said end surface and said connecting end.

7. The nozzle system of claim 6, wherein the connecting end further comprises a groove wrapping around the connecting end and ending in a hole which directs water to the impeller to cause rotation of the rotating member.

8. The nozzle system of claim 1, further comprising:

an elongated nozzle tube partially surrounding the nozzle casing.

9. A spray nozzle for a bidet, comprising:

a nozzle casing having an outlet hole defined by an inner wall of the nozzle casing through which water is sprayed;

a rotating member within the nozzle casing, the rotating member configured to rotate around an axis of rotation as water flows through the outlet hole;

wherein the rotating member comprises an axle oriented at an angle relative to the axis of rotation of the rotating member, wherein the axle extends at least partially into the outlet hole causing water to spray in a rotating pattern from the outlet hole between the axle and the inner wall during rotation of the rotating member.

10. The spray nozzle of claim 9, wherein the outlet hole has a diameter that is larger than an outer diameter of the axle such that the axle freely swings 360 degrees within the outlet hole.

11. The spray nozzle of claim 9, wherein water attaches to an outer wall of the axle when the rotating member rotates so as to direct water through the outlet hole between the axle and the inner wall of the nozzle casing.

12. The spray nozzle of claim 9, wherein the rotating member includes an impeller connected to an end of the axle, wherein the impeller includes a plurality of vanes.

13. The spray nozzle of claim 9, wherein the nozzle casing further comprises:

an upper casing; and a lower casing;

wherein the rotating member is located between the upper casing and the lower casing.

14. A spray control system for a bidet, comprising:

a lower casing;

an upper casing coupled to the lower casing, the upper casing including an outlet hole through which water is sprayed;

a rotating member disposed within a water chamber defined by the upper casing and the lower casing, the rotating member configured to spray water through the outlet hole; and a controller configured to selectively control a spray pattern from the outlet hole;

wherein the upper casing includes a first inlet pipe configured to direct a first cleaning water to suppress rotation of the rotating member; and wherein the lower casing includes a second inlet pipe configured to direct a second cleaning water to drive the rotating member.

15. The spray control system of claim 14, wherein the first inlet pipe is positioned so as to direct the first cleaning water into the water chamber above the rotating member to increase water flow resistance within the water chamber and thereby suppress rotation of the rotating member.

16. The spray control system of claim 14, wherein the second inlet pipe is positioned offset from the first inlet pipe position so as to direct the second cleaning water into the water chamber to cause the rotating member to rotate.

17. The spray control system of claim 14, wherein the controller is configured to independently control an amount of the first cleaning water and an amount of the second cleaning water introduced into the water chamber so as to selectively control the spray pattern.

18. The spray control system of claim 17, wherein the controller includes one or more settings each corresponding to a different ratio between the amount of the first cleaning water and the amount of the second cleaning water to provide different spray pattern intensities.

19. The spray control system of claim 17, further comprising a water distributor configured to:

receive a signal from the controller, and to distribute an amount of the first cleaning water and an amount of the second cleaning water according to the signal;

wherein the signal is associated with a user-requested water spray pattern.

20. The spray control system of claim 19, further comprising:

a first connecting pipe for coupling the first inlet pipe to the water distributor; and a second connecting pipe for coupling the second inlet pipe to the water distributor;

wherein the first connecting pipe is configured to direct the first cleaning water to the first inlet pipe, and wherein the second connecting pipe is configured to direct the second cleaning water to the second inlet pipe.

* * * * *